US009829255B2

(12) United States Patent
Moreau et al.

(10) Patent No.: US 9,829,255 B2
(45) Date of Patent: Nov. 28, 2017

(54) HEAT EXCHANGER WITH LATERAL FLUID SUPPLY

(75) Inventors: Sylvain Moreau, Spay (FR); Francois Busson, Saint Gervais en Belin (FR); Mohamed Ibrahimi, Allonnes (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 407 days.

(21) Appl. No.: 13/881,333

(22) PCT Filed: Oct. 21, 2011

(86) PCT No.: PCT/EP2011/068472

§ 371 (c)(1),
(2), (4) Date: Aug. 6, 2013

(87) PCT Pub. No.: WO2012/055790

PCT Pub. Date: May 3, 2012

(65) Prior Publication Data

US 2013/0312942 A1 Nov. 28, 2013

(30) Foreign Application Priority Data

Oct. 25, 2010 (FR) ..... 10 04183

(51) Int. Cl.
*F28F 3/08* (2006.01)
*F28F 1/00* (2006.01)
(Continued)

(52) U.S. Cl.
CPC ..... *F28F 1/00* (2013.01); *F28D 1/0341* (2013.01); *F28F 9/0253* (2013.01)

(58) Field of Classification Search
CPC ..... F28D 1/035; F28D 1/0341; F28F 9/0246; F28F 9/0253; F28F 1/00
(Continued)

(56) References Cited

U.S. PATENT DOCUMENTS 8,596,339 B2 * 12/2013 Palanchon ..... 165/103
2001/0027860 A1 * 10/2001 Watanabe ..... F28D 1/0333 165/178
(Continued)

FOREIGN PATENT DOCUMENTS

FR 2929388 A1 10/2009
JP 06-331297 A 11/1994
JP WO 0104560 A1 * 1/2001 ..... F28D 1/0341

OTHER PUBLICATIONS

WO 0104560 A1 abstract machine translation.*
(Continued)

*Primary Examiner* — Len Tran
*Assistant Examiner* — Gordon Jones
(74) *Attorney, Agent, or Firm* — Howard & Howard Attorneys PLLC

(57) ABSTRACT

A heat exchanger (10) includes an assembly of plates (12) stacked in pairs in a longitudinal stacking direction (x) to form a heat exchanger body (14), designed for the circulation of a fluid, comprising a connection device (19) arranged at one extremity of the heat exchanger body (14) in the longitudinal stacking direction (x). The connection device (19) includes an end plate (20) and a cover (22) that can be assembled together to jointly delimit an inlet duct (24) and an outlet duct (26), respectively, to admit the fluid into the heat exchanger body (14) and discharge the fluid from the heat exchanger body (14).

15 Claims, 3 Drawing Sheets

Figure 1:
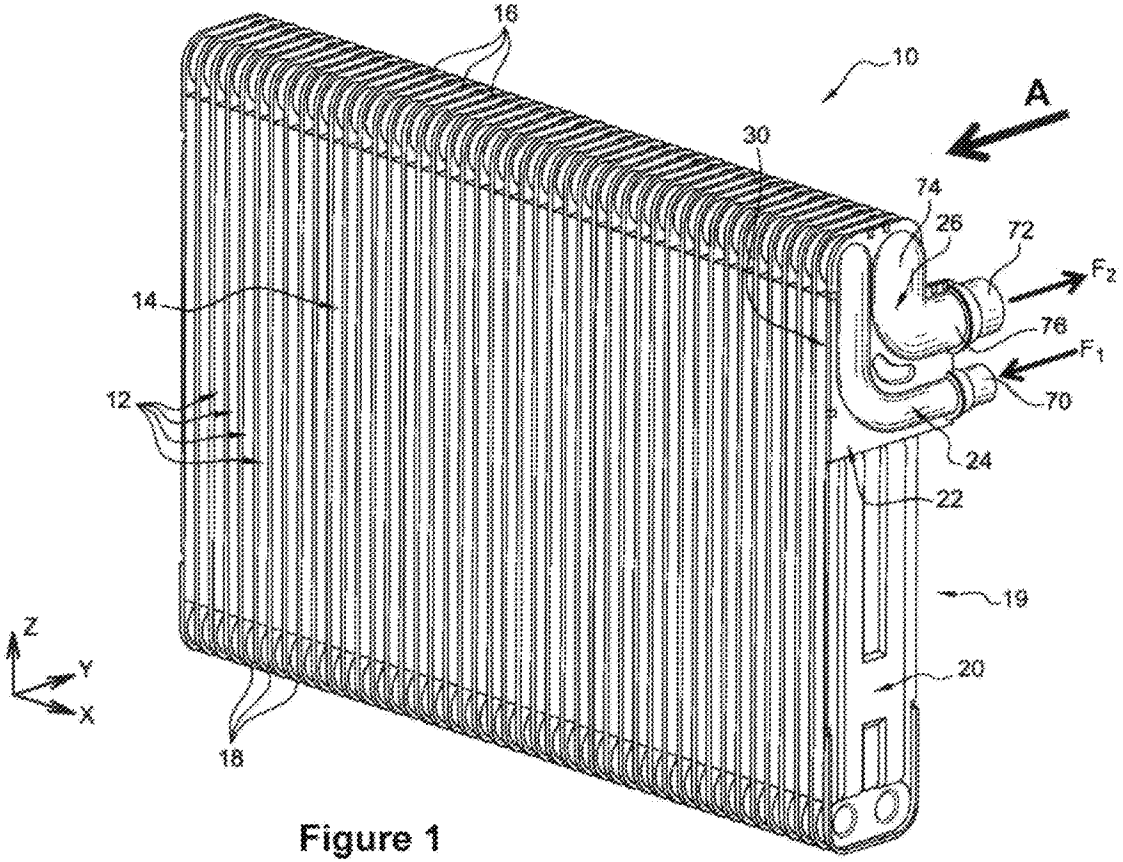

(51) Int. Cl.
*F28D 1/03* (2006.01)
*F28F 9/02* (2006.01)

(58) Field of Classification Search
USPC ..... 165/153, 178
See application file for complete search history.

(56) References Cited

U.S. PATENT DOCUMENTS

| | | | | |
|---|---|---|---|---|
| 2004/0144523 | A1 | 7/2004 | Higashiyama | |
| 2007/0144715 | A1 | 6/2007 | Ohashi | |
| 2007/0256820 | A1* | 11/2007 | Lim | F28D 1/05391 165/153 |
| 2010/0077794 | A1* | 4/2010 | Higashiyama et al. | 62/515 |

OTHER PUBLICATIONS

English language abstract and translation for FR 2929388 extracted from espacenet.com database Jul. 3, 2013, 7 pages.
English language abstract and translation for JP 06-331297 extracted from PAJ datebase Jul. 3, 2013, 26 pages.
International Search Report for Application No. PCT/EP2011/068472 dated Nov. 7, 2011, 5 pages.

* cited by examiner

HEAT EXCHANGER WITH LATERAL FLUID SUPPLY

RELATED APPLICATIONS

This application is the National Stage of International Patent Application No. PCT/EP2011/068472, filed on Oct. 21, 2011, which claims priority to and all the advantages of French Patent Application No. FR 10/04183, filed on Oct. 25, 2010, the content of which is incorporated herein by reference.

The invention relates to the field of heat exchangers, in particular for motor vehicles.

More specifically, it concerns a heat exchanger comprising an assembly of stacked pipes, for example a plate heat exchanger comprising an assembly of plates stacked in pairs, in a longitudinal stacking direction, to form a heat exchanger body intended for the circulation of a fluid.

A plate heat exchanger has an inlet pipe and a discharge pipe forming part of a circulation circuit of the fluid in question, in which at least one connection part extends in the longitudinal stacking direction. Such an arrangement is very bulky.

The invention applies in particular to evaporators designed for air conditioning installations, in which the fluid flowing in the heat exchanger body is a coolant that enters in liquid phase and leaves in gas phase following a heat exchange with an air flow passing over the heat exchanger body, which enables the air flow to be cooled before it is diffused, for example, in a motor-vehicle passenger compartment.

Furthermore, known heat exchangers are not optimized, in particular in terms of size.

The invention is particularly intended to overcome the aforementioned drawbacks of known heat exchangers.

It concerns in particular a heat exchanger of the type mentioned above that is smaller in the longitudinal stacking direction of the pipes.

The invention also concerns such a heat exchanger having an optimized pressure drop and that is particularly suited for use as an evaporator for a motor-vehicle air-conditioning installation.

For this purpose, the invention proposes a heat exchanger comprising an assembly of pipes, for example made of an assembly of plates, stacked in a longitudinal stacking direction to form a heat exchanger body designed for the circulation of a first fluid, comprising a connection device arranged at one extremity of the heat exchanger body in the longitudinal stacking direction. The connection device includes an end plate and a cover that can be assembled together to jointly delimit an inlet duct and an outlet duct, respectively, to admit the fluid into the heat exchanger body and discharge the fluid from the heat exchanger body.

In particular, the inlet duct and the outlet duct open out in a transversal direction substantially perpendicular to the longitudinal stacking direction.

Advantageously, the inlet duct and the outlet duct are generally elbow shaped.

According to the present invention, the end plate includes a pressed part comprising a first inlet impression and a first outlet impression.

Additionally, the cover includes a second inlet impression and a second outlet impression.

Thus arranged, following assembly of the pressed part of the end plate and the cover, the first inlet impression co-operates with the second inlet impression to define the inlet duct and the first outlet impression co-operates with the second outlet impression to define the outlet duct.

Advantageously, the inlet duct and the outlet duct each have cross sections essentially defined by the second inlet impression and the second outlet impression of the cover.

Specifically, the first inlet impression and the first outlet impression are of a limited depth less than a substantial depth of the second inlet impression and the second outlet impression In particular, the limited depth of the first inlet impression and the first inlet impression is less than 1 mm, preferably less than 0.5 mm, and the substantial depth of the second inlet impression and the second outlet impression is less than 10 mm, preferably less than 8 mm.

Furthermore, according to an alternative embodiment, the outlet duct has a first extremity opening into the heat exchanger body and a second extremity opening outside the heat exchanger body. Moreover, the outlet duct has a hydraulic diameter, throughout the intermediate region between the first extremity and the second extremity, of between a first hydraulic diameter value at the first extremity of the outlet duct and a second hydraulic diameter value at the second extremity of the outlet duct.

In particular, the hydraulic diameter value of the outlet duct increases from the first hydraulic diameter value at the first extremity of the outlet duct to the second hydraulic diameter value at the second extremity of the outlet duct.

Preferably, the first hydraulic diameter value is between 10.5 mm and 11 mm, preferably 10.8 mm, and/or the second hydraulic diameter value is between 15 mm and 16 mm, preferably 15.6 mm.

According to the present invention, the internal width of the outlet duct, considered in an assembly plane of the end plate and of the cover, is greater than the internal width of the inlet duct, considered in the same assembly plane.

In particular, the internal width of the outlet duct is between 14.5 mm and 16.8 mm, preferably close to 16 mm.

Finally and additionally, a pressed reservoir is placed between the end plate and an adjacent plate of the heat exchanger body, opposite the cover, to provide fluid communication with the inlet duct and the outlet duct.

The size of the inlet and outlet ducts, considered in the stacking direction, is thereby reduced. Such a size reduction is particularly sought after in air-conditioning evaporators for motor vehicles in which the width of the plates, which corresponds substantially to the thickness of the heat exchanger body, is not greater than 40 mm.

The end plate and the cover thereby form two specific components that can be assembled on an otherwise known heat exchanger body.

This enhances usability since a single heat exchanger body can be used to form a heat exchanger with either a lateral supply or an end supply.

Figure 2:
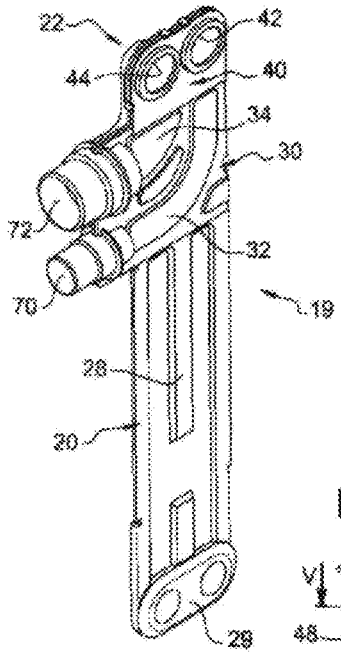
Figure 3:
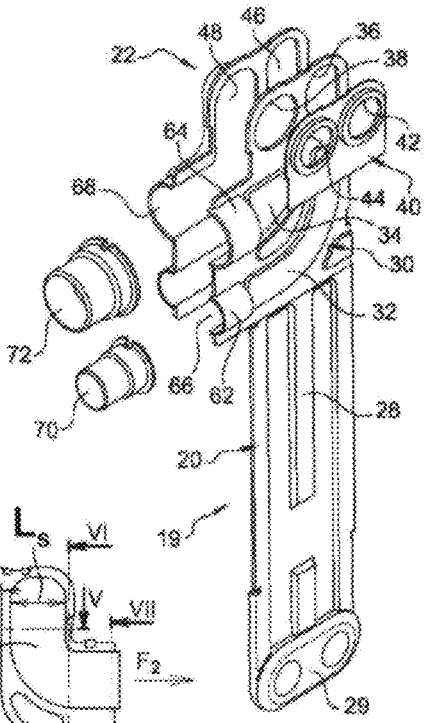
Figure 4:
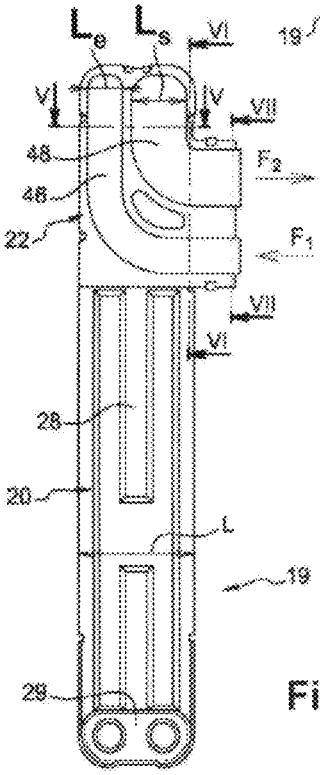

Other features and advantages of the invention are set out in the description given below in relation to the attached drawings, which are provided as non-limiting examples to assist comprehension of the present invention and the embodiment thereof, and to help define it where necessary, in which:

FIG. 1 is a perspective view of a heat exchanger according to the present invention, FIG. 2 is a perspective view of an end plate of the heat exchanger according to the present invention, FIG. 3 is an exploded perspective view of the end plate in FIG. 2, FIG. 4 is a side view of the end plate in FIG. 2, and FIGS. 5, 6 and 7 are respectively cross sections along lines V-V, VI-VI and VII-VII in FIG. 4.

Reference is first made to FIG. 1, which is a perspective view of a heat exchanger 10 that, in the example, comprises an evaporator for a motor-vehicle air-conditioning installation.

The heat exchanger 10 comprises, for example, an assembly of plates 12 stacked in pairs in a longitudinal stacking direction, or first direction x, to form a heat exchanger body 14 delimiting internal pipes for the circulation of a fluid, advantageously a coolant.

It is reiterated that the plates 12 are formed respectively from a pressed metal sheet, for example an aluminum alloy sheet, having respective assembly edges designed to be joined together, in particular by brazing, to delimit first circulation ducts of a first fluid. The first circulation ducts of the first fluid, in particular the coolant, alternate with circulation passages for a second fluid, preferably air, which passes over the outside of the heat exchanger body 14, as shown by the arrow A in FIG. 1.

The plates 12 include a first end boss 16 and a second end boss 18. Each first end boss 16 of a plate 12 is intended to be assembled with the first end boss 16 of an adjacent plate 12, in particular by brazing. Equally, each second end boss 18 of a plate 12 is intended to be assembled with the second end boss 18 of an adjacent plate 12, in particular by brazing.

The first end bosses 16, found at the top in FIG. 1 according to the example embodiment, are also each provided with two openings (not visible in FIG. 1) enabling the definition of two internal circulation ducts (not visible in FIG. 1) extending in parallel in the longitudinal stacking direction of the plates 12.

The second end bosses 18 are formed in a similar manner and also enable a further two internal circulation ducts to be defined.

The circulation ducts formed by the openings of the first end bosses 16 and the second end bosses 18 enable a fluid communication to be established between the plates 12 for circulation in one or more passes.

Such an evaporator structure is described in document FR 2929388, which contains information complementing the definition of the present invention.

Furthermore, corrugated inserts forming the heat exchange fins are placed between two pairs of adjacent plates 12 in the space between the respective first end bosses 16 and the second end bosses 18 of the pairs of plates 12, in the circulation passages for the second fluid to increase the heat exchange surface, between the first fluid, preferably the coolant, and the second fluid, preferably the air.

The heat exchanger body 14 is provided, at one of the extremities thereof, in the longitudinal stacking direction, with a connection device 19 comprising an end plate 20 or inlet/outlet plate 20.

The end plate 20 is a specific plate, the structure of which is different to the plates 12 forming the assembly of plates 12 stacked in pairs to form a heat exchanger body 14.

The end plate 20 is assembled against the plate 12 located at an extremity of the heat exchanger body 14 in the longitudinal stacking direction.

The connection device 19 also includes a cover 22, advantageously obtained by pressing, to delimit, in cooperation with the end plate 20, an inlet duct 24 and an outlet duct 26.

According to the present invention, the inlet duct 24 and the outlet duct 26 are generally elbow shaped.

The inlet duct 24 and the outlet duct 26 open internally into the heat exchanger body 14 and externally on the same side of the heat exchanger body 14 to admit and discharge the first fluid, as shown respectively by the arrows F1 and F2. Consequently, the inlet duct 24 and the outlet duct 26 open out in a transversal direction y substantially perpendicular to the longitudinal stacking direction x.

The inlet and outlet ducts 24, 26, by opening in a direction parallel to the direction of the air flow, help to simplify the route of the linking pipes between the heat exchanger 10 and an expansion valve (not shown). In consideration moreover of the placement of such an expansion valve at the border between an engine compartment and a passenger compartment, and of the placement of the evaporator in the passenger compartment, oriented such that the heat exchange surface thereof is perpendicular to the direction of air flow, such an orientation of the ducts 24 and 26 tends to result in these latter being substantially in line with the expansion valve. The linking means thus enabling the heat exchanger to be linked to the expansion valve are therefore more direct, which also helps to reduce the pressure drop in each of the pipes of said linking means.

The longitudinal stacking direction x forms a direct dihedral with the transversal direction y and a vertical direction z.

The inlet duct 24 and the outlet duct 26 communicate respectively with the two circulation ducts delimited inside the heat exchanger body 14 by the openings of the first end bosses 16.

FIGS. 2 to 4 show an assembled perspective view, an exploded view and a plan view of the end plate 20, respectively. FIGS. 2 to 4 therefore show the structure of the end plate 20 and the cover 22.

Advantageously, the end plate 20 is formed by pressing a metal sheet, for example a sheet of aluminum alloy.

The end plate 20 has a substantially rectangular wall 28, advantageously having a ribbed structure, terminating at one extremity (at the bottom in FIG. 2) in a protrusion 29 pressing against the second end boss 18 of the adjacent plate 12 to close the circulation ducts defined by the respective openings of the second end bosses 18.

At the opposite extremity (at the top in FIG. 2), the end plate 20 has a pressed part 30 that can define, in cooperation with the cover 22, the inlet duct 24 and the outlet duct 26.

The pressed part 30 includes a first inlet impression 32 helping to define the inlet duct 24 and a first outlet impression 34 helping to define the outlet duct 26.

The end plate 20 also includes an inlet opening 36 and an outlet opening 38, as shown in FIG. 3, formed in the pressed part 30 to enable a fluid communication with the circulation ducts formed by the openings of the first end bosses 16 and the second end bosses 18 defined inside the heat exchanger body 14.

According to the non-limiting example shown, the first inlet impression 32 and the first outlet impression 34 are each substantially arc shaped. In particular, the first inlet impression 32 externally surrounds the first outlet impression 34 substantially about a quarter circle, as shown in FIGS. 2 to 4.

Furthermore, the connection device 19 also includes a reservoir 40, advantageously pressed. According to an alternative embodiment, the reservoir 40 has substantially the same shape as the first end boss 16 of the plate 12.

The reservoir 40 is placed between the end plate 20 and the plate 12 located at an extremity of the heat exchanger body 14 in the longitudinal stacking direction. The reservoir 40 is arranged opposite the cover 22 in relation to the wall 28 of the end plate 20 of the connection device 19. The reservoir 40 is intended to provide a fluid communication between the heat exchanger body 14 and the inlet duct 24 and the outlet duct 26.

The reservoir 40 has an inlet opening 42 and an outlet opening 44. The inlet opening 42 and the outlet opening 44 are aligned respectively with the inlet opening 36 and the outlet opening 38 of the end plate 20, as shown in FIG. 3.

The cover 22 has a second inlet impression 46 and a second outlet impression 48, advantageously of substantial depth. The second inlet impression 46 and the second outlet impression 48 are intended respectively to face the first inlet impression 32 and the first outlet impression 34 to define the inlet duct 24 and the outlet duct 26.

According to the non-limiting example shown, the second inlet impression 46 and the second outlet impression 48 are also each substantially arc shaped. In particular, the second inlet impression 46 externally surrounds the second outlet impression 48 substantially about a quarter circle. Consequently, the inlet duct 24 and the outlet duct 26 are each substantially arc shaped, as shown in FIGS. 2 to 4.

With this arrangement, according to the example embodiment shown, the inlet duct 24 externally surrounds the outlet duct 26 substantially about a quarter circle, as shown in FIGS. 1 to 4.

Any inlet or outlet impression defining a route having an arced curve advantageously helps to reduce the pressure drop of the fluid flowing in the connection device 19.

Complementing the orientation of the inlet and outlet ducts 24, 26 in parallel in the direction of the flow of air passing through the heat exchanger, such an arced design of the impressions of the connection device advantageously helps to significantly reduce the pressure drop upstream and downstream of the body 14 of the heat exchanger 10, in relation to the flow direction of the fluid.

The connection device 19 therefore includes at least the end plate 20 and the cover 22. Additionally, the connection device 19 may also include the reservoir 40 for communication with the heat exchanger body 14.

Thus, the first inlet impression 32 and the first outlet impression 34, on the one hand, and the second inlet impression 46 and the second outlet impression 48, on the other, help to define the inlet duct 24 and the outlet duct 26 following assembly of the pressed part 30 of the end plate 20 and the cover 22, and, alternatively, the reservoir 40.

Advantageously, the second inlet impression 46 and the second outlet impression 48 are of substantial depth in relation to the first inlet impression 32 and the first outlet impression 34, which are of limited depth. Thus, the pressed depth of the first inlet impression 32 and the first outlet impression 34 is less than the pressed depth of the second inlet impression 46 and the second outlet impression 48.

This means that the internal cross sections of the inlet duct 24 and the outlet duct 26 are essentially defined by the second inlet impression 46 and the second outlet impression 48 of the cover 22. Consequently, the end plate 20 is smaller than the cover 22, in the longitudinal stacking direction.

The expression "limited depth" is also intended to mean that the pressed depth may be practically zero, at least locally, the inlet duct 24 and the outlet duct 26 being in this case primarily defined by the second inlet impression 46 and the second outlet impression 48 of the cover 22. As a result, the connection device 19, due to the limited depth of the first inlet impression 32 and the first outlet impression 34, does not encroach on the flow area, formed by the circulation passages, for the second fluid passing through the heat exchanger body 14.

Figure 5:
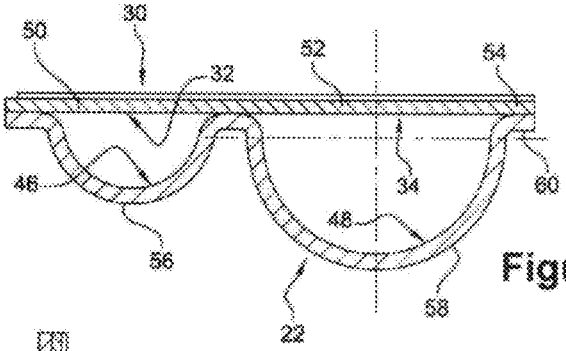
Figure 6:
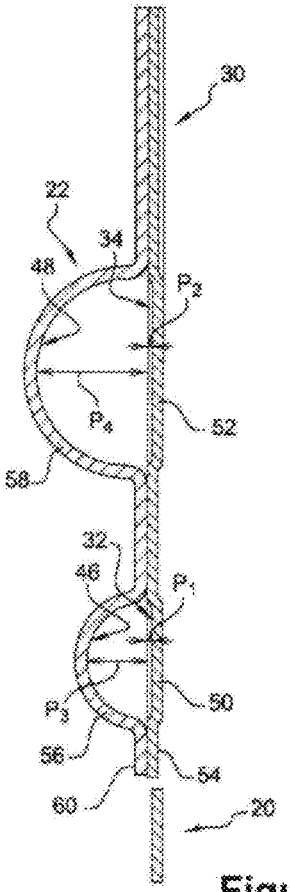
Figure 7:
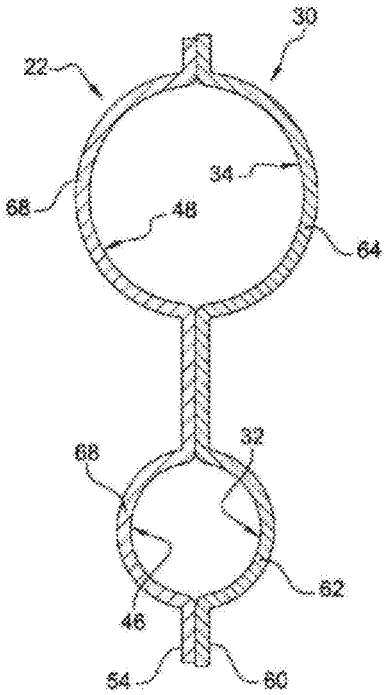

The internal cross section of the inlet duct 24 and the outlet duct 26 is tapered, as shown in FIGS. 5 to 7, which are cross sections along lines V-V, VI-VI and VII-VII respectively of FIG. 4.

As shown in FIG. 6, the first inlet impression 32 and the first outlet impression 34 of the pressed part 30 of the end plate 20 are respectively delimited by a first inlet back wall 50 and a first outlet back wall 52, which have a substantially flat profile and are connected to a first generally flat junction wall 54 that forms the wall 28 of the end plate 20. The depths of the first inlet impression 32 and the first outlet impression 34 are respectively $P_1$ and $P_2$, which may be the same or different.

The second inlet impression 46 and the second outlet impression 48 of the cover 22 are respectively delimited by a second inlet back wall 56 and a second outlet back wall 58. Advantageously, the second inlet back wall 56 and the second outlet back wall 58 are substantially semi-circle shaped and connected to a second junction wall 60 forming the cover 22. The depths of the second inlet impression 46 and the second outlet impression 48 are respectively $P_3$ and $P_4$, which may be the same or different.

The first junction wall 54 and the second junction wall 60 can be joined together along a junction plane for assembly, in particular by brazing.

In the example shown, the respective depths $P_1$ and $P_2$ of the first inlet impression 32 and the first outlet impression 34 are typically less than 1 mm, preferably 0.5 mm, in particular for plates with a width L, in the transversal direction y, of around 35 to 40 mm.

In the example shown, the respective depths $P_3$ and $P_4$ of the second inlet impression 46 and the second outlet impression 48 of the cover 22 are typically less than 10 mm, preferably less than 8 mm, for plates with a width L of around 35 to 40 mm.

The width L corresponds to the thickness of the heat exchanger body 14.

The cross section in FIG. 5 is made in the region where the inlet duct 24 and the outlet duct 26 open into the heat exchanger body 14. It is noted, by way of example, that the depths $P_1$ and $P_2$ of the first inlet impression 32 and the first outlet impression 34, in this region, are zero. Thus, along this line, the cross section of the inlet duct 24 and the outlet duct 26 is formed essentially by the second inlet impression 46 and the second outlet impression 48 of the cover 22.

As shown in FIG. 3, the first inlet impression 32 and the first outlet impression 34 of the end plate 20 terminate respectively in a first inlet half collar 62 and a first outlet half collar 64. Equally, the second inlet impression and the second outlet impression 48 of the cover 22 respectively terminate in a second inlet half collar 66 and a second outlet half collar 68.

The first inlet half collar 62 and the second inlet half collar 66 jointly define a collar, preferably circular, for the inlet duct 24. Equally, the first outlet half collar 64 and the second outlet half collar 68 jointly define a collar, preferably circular, for the outlet duct 26.

According to an alternative embodiment, shown in FIGS. 1 to 3, the collars for the inlet duct 24 and the outlet duct 26 are surrounded respectively by an inlet tip 70 and an outlet tip 72. Specifically, the inlet tip 70 and the outlet tip 72 are provided in the form of stepped sleeves. The inlet tip 70 and the outlet tip 72 enable the heat exchanger 10 to be connected to a circulation circuit of the first fluid (not shown).

The inlet and outlet tips 70, 72 are substantially tubular rings. The external diameter of each ring includes a first tubular section prolonged by a second tubular section. The external diameter of the second tubular section is greater than the diameter of the first tubular section, thereby forming a shoulder. The free end of the second tubular section has a flange. The flange and the second tubular section include means for attaching and preventing the rotation of each tip on the associated duct 70 or 72. Such attaching and rotation-prevention means comprise two notches extending across the entire thickness of the flange and a part of the second tubular section. Each notch is designed to cooperate by complementarity of shape with a set of junction walls 54, 60 formed on the plate and the cover defining the ducts 70, 72. The notches extend in a midplane of the tips 70, 72.

Fitting each of the tips 70, 72 onto the previously assembled plate and the cover enables each of the inlet and outlet ducts coming from the plate and the cover to be positioned perfectly. For this purpose, the tips thus fitted guarantee the contact and compression of the plate and the cover, which facilitates brazing of these two parts. Furthermore, such a design helps to improve the rigidity and seal of the components of the connection device 19. Moreover, the use of such tips assembled on the plate 20 and the cover 22 improves building quality in comparison to known solutions by reducing the assembly and manufacturing tolerances and play.

In the specific case of an evaporator, the first fluid flowing through the heat exchanger 10 is a phase-changing coolant, the inlet duct 24 being used to admit the first fluid in liquid phase and the outlet duct 26 being used to discharge the first fluid in vapor phase.

The present invention is intended to optimize the internal pressure drop, in particular in the outlet duct 26. The structure of the connection device 19 described above specifically enables such an optimization by dimensioning the hydraulic diameter of the outlet duct 26 between the heat exchanger body 14 and the outlet tip 72.

It is reiterated that the hydraulic diameter Dh of a pipe is 4A/P, where

A is the air in the flow area of the pipe, and

P is the wetted perimeter of the flow area of the pipe.

The outlet duct 26 has a first extremity 74 opening into the heat exchanger body 14 and a second extremity 76 opening outside the exchanger body 14, by the outlet tip 72.

The outlet duct 26 has a hydraulic diameter Dh, throughout the intermediate region between the first extremity 74 and the second extremity 76, of between a first hydraulic diameter value $Dh_1$ at the first extremity 74 and a second hydraulic diameter value $Dh_2$ at the second extremity 76. Preferably, the hydraulic diameter value Dh of the outlet duct 26 increases from the first hydraulic diameter value $Dh_1$ to the second hydraulic diameter value $Dh_2$.

As shown in FIG. 4, the outlet duct 26 has an internal width Ls, considered in an assembly plane of the end plate 20 and the cover 22. According to the present invention, the internal width Ls is greater than an internal width Le of the inlet duct 24, considered in the assembly plane of the end plate 20 and the cover 22.

By way of example, the internal width Ls of the outlet duct 26 is between 14.5 mm and 16.8 mm, preferably close to 16 mm. Equally, advantageously, the hydraulic diameter value Dh of the outlet duct 26 increases progressively from the first first value $Dh_1$ of between 10 mm and 11 mm, in particular 10.8 mm, at the first extremity 74 to the second first value $Dh_2$ of between 15 mm and 16 mm, in particular 15.6 mm, at the second extremity 76.

In an example embodiment, the width L of the plates 12, corresponding to the thickness of the heat exchanger body 14 in the transversal direction y, is 38 mm, the width Ls of the outlet duct 26 is 16 mm and the width Le of the inlet duct 24 is 10 mm. Such an arrangement corresponds respectively to 42% and 26% of the thickness of the heat exchanger 10. In this example, the depths $P_1$ and $P_2$ are 0.4 mm.

The invention therefore makes it possible to optimize the size of the heat exchanger 10 in the longitudinal stacking direction x, which is particularly important for evaporators in lateral-supply motor-vehicle air-conditioning installations. Indeed, the space allotted to such evaporators is limited and it is beneficial to limit this size. This is particularly applicable to evaporators not more than 40 mm thick.

The invention also makes it possible to optimize the hydraulic diameter of the outlet duct 26, as mentioned above.

Another additional advantage of the invention is that the end plate 20 and the cover 22 can be assembled on a standard heat exchanger body 14.

Thus, the heat exchanger body 14 can be used both for lateral-supply heat exchangers, according to the present invention, and for end-supply heat exchangers.

In all cases, the same assembly method and the same tools can be used. The components of the heat exchanger 10 are then braised together in a single operation.

Naturally, the invention is not limited to the embodiments described above and provided solely by way of example. The invention encompasses any other modifications, alternative forms or other variants that the person skilled in the art could envisage within the scope of the present invention, and in particular all combinations of the different embodiments described above.

Indeed, the present invention can also be used with heat exchangers in which the heat exchanger body is made up of pipes, regardless of whether they are made of an assembly of plates, by bending or any other method.

The invention claimed is:

1. A heat exchanger (10) comprising an assembly of plates (12) stacked in a longitudinal stacking direction (x) to form a heat exchanger body (14) designed for the circulation of a first fluid, comprising a connection device (19) arranged at one extremity of the heat exchanger body (14) in the longitudinal stacking direction (x), wherein the connection device (19) includes an end plate (20) terminating at one end in a protrusion (29) and a cover (22) that are assembled together to jointly delimit an inlet duct (24) and an outlet duct (26), respectively, to admit the fluid into the heat exchanger body (14) and discharge the fluid from the heat exchanger body (14), wherein each one of the plates (12) comprising the assembly of plates (12) includes a first end boss (16) located at one end of the plate (12) and a second end boss (18) located at an opposite end of the plate (12) such that each one of the plates (12) defines a length extending in a vertical direction (z) from the first end boss (16) to the second end boss (18), wherein the vertical direction (z) is substantially perpendicular to the longitudinal stacking direction (x), wherein each first end boss (16) and each second end boss (18) has openings extending in parallel to the longitudinal stacking direction (x) of the plates (12), wherein the respective openings of the second end bosses (12) define circulations ducts;

wherein the end plate (20) is assembled adjacent to an endmost one of the assembly of plates (12) located at the one extremity of the heat exchanger body (14) such that the end plate (20) extends along the length of the endmost one of the assembly of plates (12) from the first end boss (16) to the second end boss (18) and such that the protrusion (29) of the end plate (20) is pressed against the second end boss (18) of the endmost one of the plates (12) to close the circulation ducts defined by the respective openings of the second end boss (18), wherein the inlet duct (24) and the outlet duct (26) open out in a transversal direction (y) substantially perpendicular to the longitudinal stacking direction (x), and wherein the inlet duct (24) and the outlet duct (26) provide parallel arced flows which do not overlap each other in the longitudinal stacking direction (x).

2. The heat exchanger (10) as claimed in claim 1, wherein the end plate (20) has a pressed part (30) including a first inlet impression (32) and a first outlet impression (34).

3. The heat exchanger (10) as claimed in claim 2, wherein the cover (22) includes a second inlet impression (46) and a second outlet impression (48).

4. The heat exchanger (10) as claimed in claim 2, wherein the first inlet impression (32) cooperates with a second inlet impression (46) to define the inlet duct (24) and the first outlet impression (34) cooperates with a second outlet impression (48) to define the outlet duct (26).

5. The heat exchanger (10) as claimed in claim 4, wherein the inlet duct (24) and the outlet duct (26) each have cross sections essentially defined by the second inlet impression (46) and the second outlet impression (48) of the cover (22).

6. The heat exchanger (10) as claimed in claim 2, wherein a depth ($P_1$, $P_2$) of the first inlet impression (32) and the first outlet impression (34) are less than a depth ($P_3$, $P_4$) of the second inlet impression (46) and the second outlet impression (48).

7. The heat exchanger (10) as claimed in claim 6, wherein the depth ($P_1$, $P_2$) of the first inlet impression (32) and the first inlet impression (34) is less than 1 mm.

8. The heat exchanger (10) as claimed in claim 6, wherein the depth ($P_3$, $P_4$) of the second inlet impression (46) and the second outlet impression (48) is less than 10 mm.

9. The heat exchanger (10) as claimed in claim 1, wherein the outlet duct (26) has a first extremity (74) opening into the heat exchanger body (14) and a second extremity (76) opening outside the heat exchanger body (14), and the outlet duct (26) has a hydraulic diameter (Dh), throughout an intermediate region between the first extremity (74) and the second extremity (76) between a first hydraulic diameter value ($Dh_1$) at the first extremity (74) of the outlet duct (26) and a second hydraulic diameter value ($Dh_2$) at the second extremity (76) of the outlet duct (26).

10. The heat exchanger (10) as claimed in claim 9, wherein the hydraulic diameter value (Dh) of the outlet duct (26) increases from the first hydraulic diameter value ($Dh_1$) at the first extremity (74) of the outlet duct (26) to the second hydraulic diameter value ($Dh_2$) at the second extremity (76) of the outlet duct (26).

11. The heat exchanger (10) as claimed in claim 10, wherein the first hydraulic diameter value ($Dh_1$) is between 10.5 mm and 11 mm.

12. The heat exchanger (10) as claimed in claim 10, wherein the second hydraulic diameter value ($Dh_2$) is between 15 mm and 16 mm.

13. The heat exchanger (10) as claimed in claim 1, wherein an internal width (Ls) of the outlet duct (26), considered in an assembly plane of the end plate (20) and of the cover (22), is greater than an internal width (Le) of the inlet duct (24), considered in the assembly plane of the end plate (20) and of the cover (22).

14. The heat exchanger (10) as claimed in claim 13, wherein the internal width (Ls) of the outlet duct (26) is between 14.5 mm and 16.8 mm.

15. The heat exchanger (10) as claimed in claim 1, wherein a pressed reservoir (40) is placed between the end plate (20) and an adjacent plate (12) of the heat exchanger body (14), opposite the cover (22), to provide fluid communication with the inlet duct (24) and the outlet duct (26).

* * * * *